US006223576B1

(12) United States Patent
Mashita

(10) Patent No.: US 6,223,576 B1
(45) Date of Patent: May 1, 2001

(54) METHOD OF THICKENING PERIPHERAL PORTION OF CIRCULAR PLATE BLANK BY HOLDING BLANK IN PRESSING CONTACT WITH BOTTOM SURFACE OF FORMING GROOVE FORMED IN ROLLER DIE

(75) Inventor: Junji Mashita, Kariya (JP)

(73) Assignee: Aisin Kiko Co., Ltd., Kariya (JP)

( * ) Notice: Subject to any disclaimer, the term of this patent is extended or adjusted under 35 U.S.C. 154(b) by 0 days.

(21) Appl. No.: 09/468,357

(22) Filed: Dec. 21, 1999

(30) Foreign Application Priority Data

Dec. 25, 1998 (JP) ..... 10-369859

(51) Int. Cl.[7] ..... B21H 1/04
(52) U.S. Cl. ..... 72/102; 72/111
(58) Field of Search ..... 72/68, 102, 110, 72/111; 29/893.32

(56) References Cited

U.S. PATENT DOCUMENTS 5,904,060 * 5/1999 Kanemitsu et al. ..... 72/110

FOREIGN PATENT DOCUMENTS 8-112639 5/1996 (JP) .
9-10885 1/1997 (JP) .
9-66330 3/1997 (JP) .
9-85370 3/1997 (JP) .
96/22847 8/1996 (WO) .

* cited by examiner

*Primary Examiner*—Lowell A. Larson
(74) *Attorney, Agent, or Firm*—Oliff & Berridge, PLC.

(57) ABSTRACT

A method of thickening a peripheral portion of a circular plate blank, wherein the blank is held on a jig with its peripheral portion extending radially outwardly from the outer circumferential surface of the jig, and rotated such that the outer circumferential surface of the blank is held in pressing contact with the bottom surface of an annular forming groove formed in a rotatably supported roller die which has first and second spaced-apart side surfaces connected to each other by the bottom surface, the first side surface being inclined with respect to the radial direction of the blank holder jig such that the axial distance between the two side surfaces increases in the radially outward direction, and wherein the force between the blank and the bottom surface of the groove is controlled so that the peripheral portion is held flexed in a convex shape following the first side surface and so that the end part of the peripheral portion is thickened in opposite directions toward the two side surfaces while the peripheral portion is spaced from the side surfaces and prevented from buckling within the groove.

14 Claims, 7 Drawing Sheets

METHOD OF THICKENING PERIPHERAL PORTION OF CIRCULAR PLATE BLANK BY HOLDING BLANK IN PRESSING CONTACT WITH BOTTOM SURFACE OF FORMING GROOVE FORMED IN ROLLER DIE

This application is based on Japanese Patent Application No. 10-369859 filed Dec. 25, 1998, the content of which is incorporated hereinto by reference.

BACKGROUND OF THE INVENTION

1. Field of the Invention

The present invention relates in general to a method of forming a peripheral portion of a blank in the form of a circular plate so as to increase the thickness of the peripheral portion, and more particularly to such a method which permits desired thickening of the peripheral portion with comparatively easy control of a swaging force acting between the peripheral portion and a roller die, while avoiding buckling or folding of the peripheral portion.

2. Discussion of the Related Art

Automotive vehicles use a drive plate such as a flywheel connected to a crankshaft of an engine. Conventionally, such a drive plate consists of a circular plate and a ring gear fixedly mounted on the circumferential surface of the circular plate. To meet a recent need for further reduction of the cost of manufacture of the drive plate, there has been proposed an integral or one-piece type drive plate consisting of a circular plate whose outer peripheral portion is formed into an integral toothed portion. For increased shock or impact resistance and mechanical strength, it is desired that the drive plate be formed to have a larger thickness at its peripheral portion than at its radially inner portion. An example of a method to thicken the peripheral portion of a blank in the form of a circular plate uses a rotary swaging apparatus which includes (a) a rotatably supported roller die having an annular forming groove which is open in its outer circumferential surface and substantially V-shaped in cross section in a plane including an axis Si of rotation of the roller die such that an axial dimension of the forming groove as measured in an axial direction of the roller die increases in a radially outward direction of the roller die, (b) a blank holder jig which is rotated about an axis S2 of rotation thereof and which holds the blank such that the blank is coaxial with the blank holder jig and has a peripheral portion which extends radially outwardly from the blank holder jig over a predetermined radial distance, and (c) a drive device for rotating the roller die and the blank holder jig about their respective axes S1 and S2, such that the blank is held pressed at its outer circumferential surface, in rolling contact with a bottom surface of the forming groove of the roller die, so that the peripheral portion of the blank is thickened following the cross sectional shape of the forming groove.

JP-A-9-10885 shows such a method, wherein the axes S1, S2 of rotation of the roller die and the blank holder jig are parallel with each other, and the blank is held by the blank holder jig such that the blank is subsonically aligned with the forming groove in the roller die, in the axial direction of the roller die and the blank holder jig, and the roller die and the blank holder jig are moved toward each other in the radial direction so that the peripheral portion of the blank 104 is swaged into a thickened portion 100 as shown in FIG. 6A. The thickened portion 100 is thickened substantially symmetrically on both of its upper and lower sides, to have an arrow shape in cross section in a plane parallel to a direction of thickness of the blank. The peripheral portion of the blank is swaged in two steps into the thickened portion 100, which is then bent or folded almost at right angles, by a roller die 102, so that the blank has a cylindrical peripheral portion 108 which extends from one of the opposite surfaces of a radially inner flat portion 106 of the blank 104 in the axial direction, as shown in FIGS. 6A–6C.

In the conventional method of swaging the peripheral portion of the blank, the peripheral portion of the blank must be forced against the bottom surface of the forming groove of the roller die so that the peripheral portion is thickened substantially symmetrically on the opposite sides of the blank while the blank is held substantially flat, except the radially outermost part being thickened. However, the peripheral portion of the blank tends to buckle soon after the force acting between the blank and the roller die in the radial direction of the roller die exceeds a given critical value. It is considerably difficult to control this radial force so as to thicken the peripheral portion without buckling. Further, the thickened peripheral portion 100 which has been formed by the swaging described above is subsequently bent or folded about 90° by the roller die 102 to form the cylindrical peripheral portion 108, as described above. Accordingly, the cylindrical portion 108 suffers from undesirable folds (hairpin bend) as indicated at A in FIG. 6C. These folds A adversely influence a subsequent forging or machining operation on the cylindrical peripheral portion 108 to form a toothed portion. Namely, the formed toothed portion may not have sufficiently high degrees of durability and mechanical strength, during use of a drive plate having the toothed portion at its periphery.

JP-A-9-66330 shows another method of thickening the peripheral portion of a circular plate blank, wherein the peripheral portion of the blank is brought into sliding contact with one of opposed side surfaces which partially define a forming groove formed in a roller die, so that the outer circumferential surface of the peripheral portion is brought into abutting contact with the other side surface of the forming groove, so as to bend the peripheral portion into a substantially L-shaped thickened peripheral portion. This method also suffers from buckling of the peripheral portion of the blank toward the above-indicated other side surface of the forming groove when the force acting between the blank and the roller die exceeds a critical value. In this method, too, the force is difficult to control for intended thickening of the peripheral portion of the blank without buckling. If the thickening operation is continued after the buckling, the peripheral portion of the blank has a meandering or alternating flow of the material, as indicated at fM in FIG. 7 during the thickening operation, causing a fold between alternate curves of the material flow. It is noted that FIG. 7 corresponds to the cross sectional view of FIG. 6C. The alternating flow of the material is generated by initial buckling of the peripheral portion of the blank from the above-indicated one side surface of the forming groove toward the other side surface, and subsequent buckling of the peripheral portion in the reverse direction toward the above-indicated one side surface, as a reaction of the initial buckling. If an angle β one side surface 110 of a forming groove with respect to the radial direction of the roller die is larger than 15°, as indicated in FIG. 8, a blank 112 in the form of a circular plate is buckled at its peripheral portion, as indicated at B in FIG. 8, toward the other side surface 114 of the forming groove, without thickening of the peripheral portion. In this case, the thickening operation is restricted.

SUMMARY OF THE INVENTION

It is therefore an object of the present invention to provide a method of forming a peripheral portion of a blank in the form of a circular plate, so as to thicken the peripheral portion, which method reduces or eliminates at least one of the problems encountered in the prior art described above.

The above object may be achieved according to the principle of this invention, which provides a method of forming a peripheral portion of a blank in the form of a circular plate, so as to thicken the peripheral portion, comprising the steps of: providing a roller die supported rotatably about an axis thereof and having an outer circumferential surface and an annular forming groove which is open in the outer circumferential surface, the forming groove having a first side surface, a second side surface spaced from the first side surface in an axial direction of the roller die, and a bottom surface which has rounded end portions smoothly connecting the first and second side surfaces; providing a blank holder jig which has an axis of rotation and an outer circumferential surface and which holds the blank; holding the blank on the blank holder jig such that the blank is coaxial with the blank holder jig and the peripheral portion extends radially outwardly from the outer circumferential surface over a predetermined radial distance; rotating the blank about the axis of the blank holder jig such that the blank is held in pressing contact at an outer circumferential surface thereof with the bottom surface of the annular forming groove of the roller die, so that the outer peripheral portion of the blank is thickened following a shape of the forming groove in cross section taken in a plane including the axis of the roller die; forming the first side surface and positioning the roller die relative to the blank holder jig such that the first side surface is inclined at an angle $\alpha 1$ larger than 0° with respect to a radial direction of the blank holder jig such that an axial distance between the first and second side surfaces in an axial direction of the blank holder jig increases in a radially outward direction of the roller die; and controlling a force acting between the outer circumferential surface of the blank and the bottom surface of the forming groove, during rotation of the blank in pressing contact with the bottom surface, so that the outer peripheral portion of the blank is held flexed in a convex shape following the first side surface and so that a radially outermost part or extreme end part of the outer peripheral portion is thickened in opposite directions toward the first and second side surfaces while the outer peripheral portion is spaced apart from the first and second side surfaces, and is prevented from buckling within the forming groove.

In the method of the present invention described above, the first side surface of the annular forming groove is formed and the roller die is positioned relative to the blank holder jig (relative to the blank) such that the first side surface is inclined at the angle al larger than 0° with respect to a straight line perpendicular to the axis of the blank holder jig, that is, with respect to the radial direction of the blank holder jig, such that the axial distance between the first and second side surfaces in the axial direction of the blank holder jig increases in the radially outward direction of the roller die. Further, the force acting between the outer circumferential surface of the blank and the bottom surface of the forming groove is controlled, during rotation of the blank in pressing contact with the bottom surface, so that the outer peripheral portion of the blank which extends radially outwardly from the blank holder jig is held flexed in a convex shape following the first side surface, while the outer peripheral portion is spaced apart from the first and second side surfaces and prevented from buckling within the forming groove, whereby the radially outermost part of the outer peripheral portion of the blank can be thickened in opposite directions toward the first and second side surfaces, without buckling of the outer peripheral portion. For instance, the force can be easily adjusted so as to permit efficient thickening of the radially outermost part of the blank while avoiding its buckling, by monitoring the state of flexural deformation of the outer peripheral portion of the blank.

Since the thickening of the radially outermost part of the blank is effected so as to prevent the outer peripheral portion of the blank from contacting the first and second side surfaces of the forming groove, the cross sectional shapes or configurations of the side surfaces which determine the shape of the thickened radially outermost part or extremely peripheral part of the blank can be designed with a high degree of freedom, unless the side surfaces adversely influence the flexure of the outer peripheral portion of the blank during the thickening operation.

The present method can be suitably practiced for manufacturing an intermediate product which is processed into a drive plate for an automotive vehicle, which drive plate includes a toothed outer cylindrical portion having a relatively large wall thickness. However, the present method may be used for manufacturing various other members which have an outer cylindrical portion with a relatively large wall thickness.

Although it is preferred that both of the angles $\alpha 1$ and $\alpha 2$ of inclination of the first and second side surfaces of the annular forming groove of the roller die be larger than 0° so that the axial distance between the two side surfaces increases in the radially outward direction of the roller die, the angle $\alpha 2$ of inclination of the second side surface may be zero or even a negative angle. Where the angle $\alpha 2$ is negative, the second side surface is inclines with respect to the line perpendicular to the axis of rotation of the blank holder jig, on the side of the first side surface. The first and second side surfaces may have two or more radial portions having respective different angles, or arcuately curved portions, provided that the first side surface is generally inclined with respect to the radial direction of the blank holder jig.

In a first preferred form of the present invention, the bottom surface of the annular forming groove is formed such that the bottom surface has an intermediate straight portion which is located between the rounded end portions and which has a dimension substantially equal to a thickness "t" of the blank, so that the intermediate straight portion serves to position the outer circumferential surface of the blank in an axial direction of the roller die, upon abutting contact of the outer circumferential surface with the intermediate straight portion.

In a second preferred form of this invention, the bottom surface of the annular forming groove has an angle $\alpha 3$ of inclination with respect to the axis of rotation of the blank holder jig such that a distance between the axis of rotation of the blank holder jig and the bottom surface at a circumferential position of the bottom surface at which the bottom surface contacts the outer circumferential surface of the blank increases in an axial direction of the blank holder jig from the second side surface toward the first side surface.

In the above form of the invention, the outer peripheral portion of the blank can be flexed, with high stability, in a convex shape following the shape of the first side surface, since the bottom surface of the forming groove is inclined at $\alpha 3$ with respect to the axis of rotation of the blank holder jig such that the distance between the axis of rotation of the blank holder jig and the point of contact of the bottom surface with the blank in the radial direction of the blank holder jig increases in the axial direction of the blank holder jig from the second side surface toward the first side surface.

In a third preferred form of the invention, the blank is held by the blank holder jig such that the blank is substantially aligned with the first side surface of the annular forming groove in the axial direction of the blank holder jig, before the blank is brought into pressing contact with the roller die. The method in this form of the invention further comprises a step of moving the blank holder jig and the roller die relative to each other in the radial direction of the blank holder jig, while the blank is rotated about the axis thereof, so that the outer peripheral portion of the blank is thickened.

According to the third preferred form of this invention, the blank is initially aligned with the first side surface in the axial direction of the blank holder jig (of the blank), and the blank and the roller die are subsequently moved relative to each other, more precisely, toward each other, in the radial direction of the blank holder jig. In this arrangement, the initial thickening of the radially outermost part of the outer peripheral portion, which initially takes place in the opposite axial directions toward the first and second side surfaces, is followed by the subsequent thickening which takes place asymmetrically on the first and second side surfaces. That is, after the radially outermost part of the outer peripheral portion is thickened up to the initial axial position of the blank held by the blank holder, the thickening takes place primarily on the side of the second side surface, so that the thickened peripheral portion can be suitably offset on the side of the second side surface, without folding of the outer peripheral portion within the annular forming groove.

In one advantageous arrangement of the above third preferred form of the invention, the bottom surface of the annular forming groove has an angle $\alpha 3$ of inclination with respect to the axis of rotation of the blank holder jig such that a distance between the axis of rotation of the blank holder jig and the bottom surface at a circumferential position of the bottom surface at which the bottom surface contacts the outer circumferential surface of the blank increases in an axial direction of the blank holder jig from the second side surface toward the first side surface, the angle $\alpha 3$ of inclination of the bottom surface being determined such that an angle $\alpha 5$ which is formed, on the side of the first side surface, between the bottom surface and a line L connecting points P1 and P2 upon abutting contact of the outer circumferential surface of the blank with the bottom surface is not smaller than 90°, wherein the point P1 is a center point of a thickness of the blank which lies on the outer circumferential surface of the blank holder jig, while the point P2 is a center point of the bottom surface as measured in the direction of thickness of the blank.

In the above arrangement, the angle $\alpha 3$ of inclination of the bottom surface with respect to the axis of rotation of the blank holder jig is determined such that the angle $\alpha 5$ formed on the side of the first side surface between the bottom surface of the groove and the above-identified line L upon abutting contact of the outer circumferential surface of the blank with the bottom surface is 90° or larger, so that the outer circumferential surface of the blank is brought into abutting contact with the bottom surface such that the thickness centerline of the blank at its radially outermost part of the outer peripheral portion of the blank is substantially perpendicular to the bottom surface, or slightly inclined with respect to a line perpendicular to the bottom surface, on the side of the first side surface, so as to prevent the initial asymmetric thickening of the radially outermost part of the blank, namely, so as to prevent a larger amount of flow of the blank material flow toward the second side surface.

Where the bottom surface of the annular forming groove is inclined at the angle $\alpha 3$ with respect to the axis of the blank holder jig, the angle $\alpha 3$ may be determined such that a thickness centerline of the blank at a radially outermost part of the outer peripheral portion of the blank is almost perpendicular to the bottom surface when the radially outermost part of the blank is flexed in the convex shape following the first side surface with the outer circumferential surface of the blank held in pressing contact with the bottom surface of the forming groove. In this instance, a reaction force received by the outer circumferential surface of the blank from the bottom surface of the forming groove is almost evenly distributed on the opposite sides of the blank toward the first and second side surfaces of the forming groove, whereby the radially outermost part of the blank can be efficiently and stably thickened in the opposite directions toward the two side surfaces.

The roller die and the work holder jig may be positioned relative to each other such that the axes of rotation of the roller die are parallel with each other, and the roller die and the blank holder jig are moved relative to each other in the radial direction of the blank holder jig along a straight line connecting the axes. Alternatively, the roller die and the work holder jig may be positioned relative to each other such that the axes are inclined relative to each other in a plane including the axes, and the roller die and the work holder jig are moved relative to each other along a straight line connecting the axes in the above-indicated plane, or a circular arc which passes an outer periphery of the blank and an outer periphery of the annular forming groove in the above-indicated plane. Where the axes of rotation of the roller die and the blank holder jig are parallel with each other, the roller die and the blank holder jig may be positioned closer to each other than where the axes are inclined relative to each other.

The thickening of the outer peripheral portion of the blank is initiated at the extreme end of the blank adjacent to the outer circumferential surface, immediately after the outer circumferential surface of the blank is brought into abutting contact with the bottom surface of the annular forming groove. The thickening of the outer peripheral portion is influenced by not only the force acting between the outer circumferential surface and the bottom surface, but also the rotating speed of the roller die, the friction coefficient of the surfaces of the forming groove, the modulus of elasticity of the blank, the presence or absence of a lubricant on the contacting surfaces of the blank and the forming groove, and the ambient temperature and humidity. As the thickening of the outer peripheral portion of the blank progresses, the radial distance of the outer peripheral portion radially outwardly extending from the outer circumferential surface of the blank holder jig is reduced, and the outer peripheral portion becomes less likely to buckle, so that the force acting between the blank and the roller die can be increased, provided the rotating speed of the roller die and the other blank thickening conditions remain unchanged. Accordingly, it is desirable that the force acting between the blank and the forming groove while the outer peripheral portion of the blank is held flexed in the convex shape following the first side surface of the forming groove be controlled on the basis of an output signal of a displacement sensor adapted to detect the state of flexural deformation of the outer peripheral portion, so as to maintain the optimum state of flexural deformation of the outer peripheral portion, for maximizing the efficiency of thickening of the outer peripheral portion while preventing the outer peripheral portion from buckling or contacting the side surfaces of the forming groove. The pressing force acting between the blank and the roller die may be kept at an optimum value determined by experimentation, or may be changed according to a predetermined pattern obtained by experimentation.

Where the blank holder jig and the roller die are moved relative to each other by a drive device including an electric motor, the pressing force may be controlled by controlling the torque of the electric motor. Where the relative movement of the blank holder jig and the roller die is effected by a fluid-actuated cylinder such as a hydraulically actuated cylinder, the pressing force may be controlled by controlling the pressure of the working fluid used for the cylinder. Further, the pressing force may be controlled by controlling the speed of the relative movement of the blank holder jig and the roller die.

In the method of the present invention, the radially outermost part of the outer peripheral portion of the blank is thickened while the outer peripheral portion is held flexed by a desired amount and is prevented from buckling and contacting the first and second side surfaces of the annular forming groove. However, the outer peripheral portion is not required to be kept spaced apart from the first and second side surfaces during the entire period of thickening of the radially outermost part of the blank. Namely, the outer peripheral portion is required to be kept spaced apart from the side surfaces at least during an initial portion or a first half of the thickening operation, in which the outer peripheral portion is comparatively likely to buckle. In the second or latter half of the thickening operation in which the outer peripheral portion is comparatively unlikely to buckle, the outer peripheral portion may be in contact with the first side surface, so that the thickening takes place primarily toward or on the side of the second side surface.

As described above, thickening of the radially outermost part of the blank is effected while the blank is rotated in pressing contact with the bottom surface of the forming groove, it is desirable to positively rotate only one of the roller die and the blank holder jig relative to the other of the roller die and the blank holder jig, by activating a suitable rotating device, while the above-indicated other of the roller die and the blank holder jig is rotatably supported by a suitable rotary holding device, so that the above-indicated other of the roller die and the blank holder jig is rotated in rolling contact with the blank. This arrangement is desirable in view of a gradual reduction of the outside diameter of the circular plate blank as the thickening of the radially outermost part progresses. However, both of the roller die and the blank holder jig may be positively rotated.

For simplifying the construction of the apparatus for practicing the present method, it is desirable to move only one of the roller die and the blank holder jig relative to the other of the roller die and the blank holder jig, by activating a feeding device. However, both of the roller die and the blank holder jig may be moved relative to each other.

Although the angle $\alpha 3$ of inclination of the bottom surface of the forming groove with respect to the axis of rotation of the blank holder jig is preferably determined as described above with respect to the advantageous arrangement of the third preferred form of the invention and the fourth preferred form of the invention, the second preferred form of the invention simply requires the angle $\alpha 3$ to be larger than 0°.

In the above-indicated third preferred form of the invention wherein the blank is initially substantially aligned with the first side surface of the forming groove in the axial direction, the blank may be held by the blank holder jig such that the blank is substantially aligned with a position of a radially outer end of the first side surface of the annular forming groove in the axial direction of the blank holder jig, before the outer peripheral portion of the blank is brought into abutting contact with the first side surface, so that the outer peripheral portion is flexed by sliding pressing contact at a peripheral edge thereof with the first side surface as the blank holder jig and the roller die are moved toward each other. Alternatively, the blank may be held by the blank holder jig such that the blank is substantially aligned with a position of the bottom surface of the annular forming groove in the axial direction of the blank holder jig, before the outer circumferential surface of the blank is brought into abutting contact with the bottom surface, the method further comprising a step of moving one of the blank and the roller die in the axial direction of the blank, with the outer circumferential surface being held in pressing contact with the bottom surface, for flexing the outer peripheral portion of the blank in the convex shape following the first side surface.

In the above-indicated third preferred form of the invention, the thickening takes place primarily on the side of the second side surface, after the radially outermost part of the blank has been thickened up to the initial axial position of the blank held by the blank holder jig, so that the thickened peripheral portion is offset one of the opposite sides of the blank which corresponds to the second side surface. However, the thickening of the radially outermost part of the blank may take place symmetrically on the opposite sides of the blank toward the first and second side surfaces of the forming groove.

BRIEF DESCRIPTION OF THE DRAWINGS

The above and optional objects, features, advantages and technical and industrial significance of this invention will be better understood and appreciated by reading the following detailed description of presently preferred embodiments of the invention, when considered in connection with the accompanying drawings, in which.

DETAILED DESCRIPTION OF THE PREFERRED EMBODIMENTS

Figure 1:
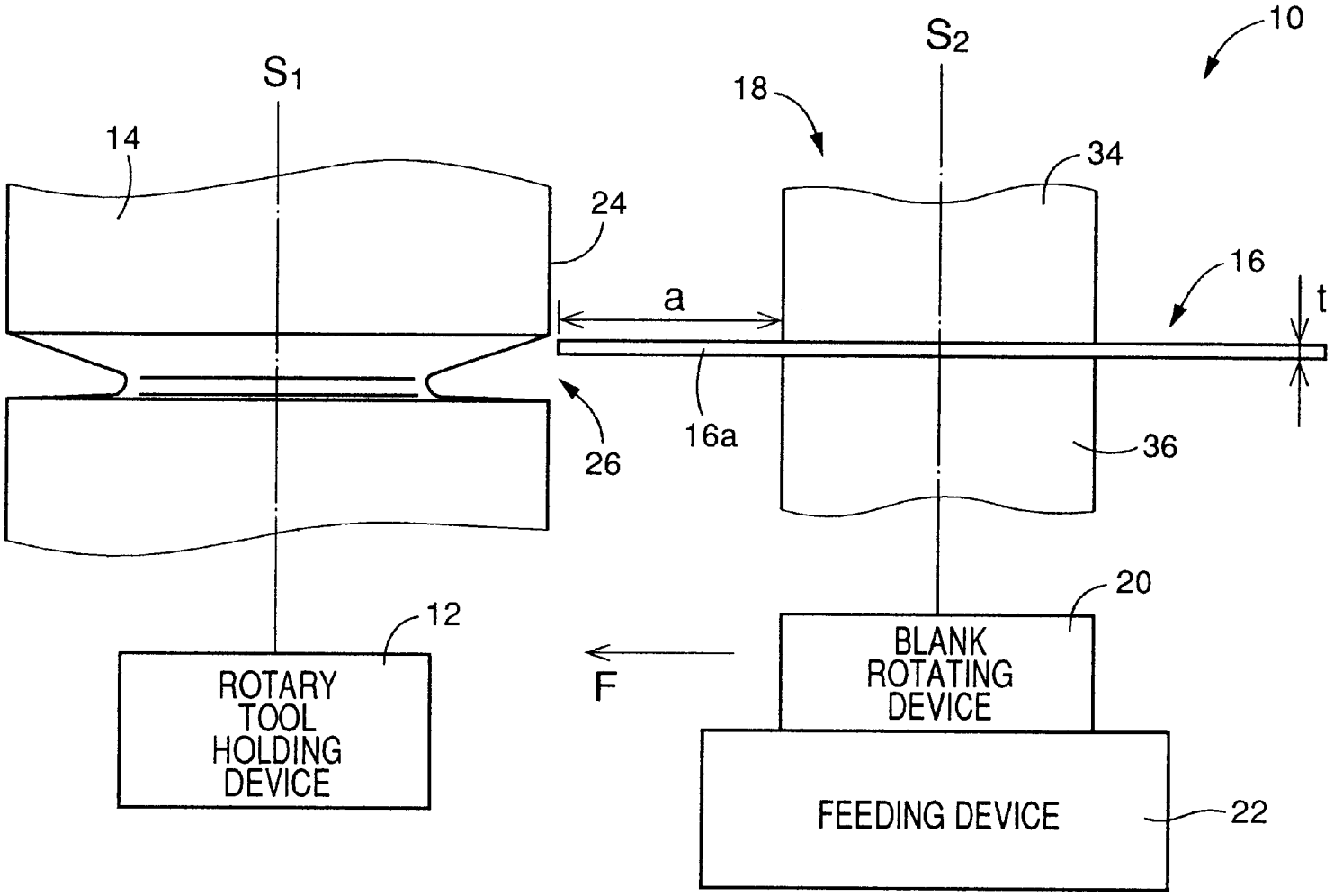
FIG. 1 is a schematic view showing an example of a rotary swaging apparatus adapted to practice a method of forming a peripheral portion of a circular plate blank so as to increase the thickness of the peripheral portion according to the principle of this invention.

Referring to FIG. 1, the rotary swaging apparatus schematically shown therein is adapted to practice a method of forming a peripheral portion of a blank in the form of a circular plate. The rotary swaging apparatus 10 includes a rotary tool holding device 12 including a suitable bearing, and a roller die 14 which is supported by the rotary tool holding device 12 such that the roller die 14 is rotatable about an axis S1 of rotation, which extends substantially in the vertical direction. The rotary swaging apparatus 10 further includes a blank holder jig 18 for holding a blank 16 in the form of a circular plate, a blank rotating device 20 for rotating the blank holder jig 18 about an axis S2 parallel to the axis S1, and a feeding device 22 for linearly moving the blank rotating device 20 in a radial direction of the roller die 14.

The blank holder jig 18 is arranged to hold the blank 16 such that the blank 16 in the form of the circular plate is coaxial with the blank holder jig 18, namely, extends in the radial direction of the blank holder jig 18. The blank rotating device 20 includes an electric motor connected to the blank holder jig 18, for rotating the blank holder jig 18 and the blank 16 about the axis S2. The blank rotating device 20 is mounted on the feeding device 22, so that the blank rotating device 20 and the blank holder jig 18 are linearly moved by the feeding device 22 in the radial direction of the roller die 14, such that the axis S2 of rotation of the blank holder jig 18 and the blank 16 is moved toward and away from the axis S1 of the roller die 14.

The roller die 14 may be rotated about its axis S1 at a suitable speed by a suitable rotating device such as an electric motor. Although the feeding device 22 provided in the present embodiment is arranged to move the blank 16 relative to the roller die 14, a similar feeding device may be provided to move the roller die 14 relative to the blank 16 (blank holder jig 18). Further, both of the roller die 14 and the blank 16 (blank holder jig 18) may be moved relative to each other by respective feeding devices or a single feeding device.

Figure 2:
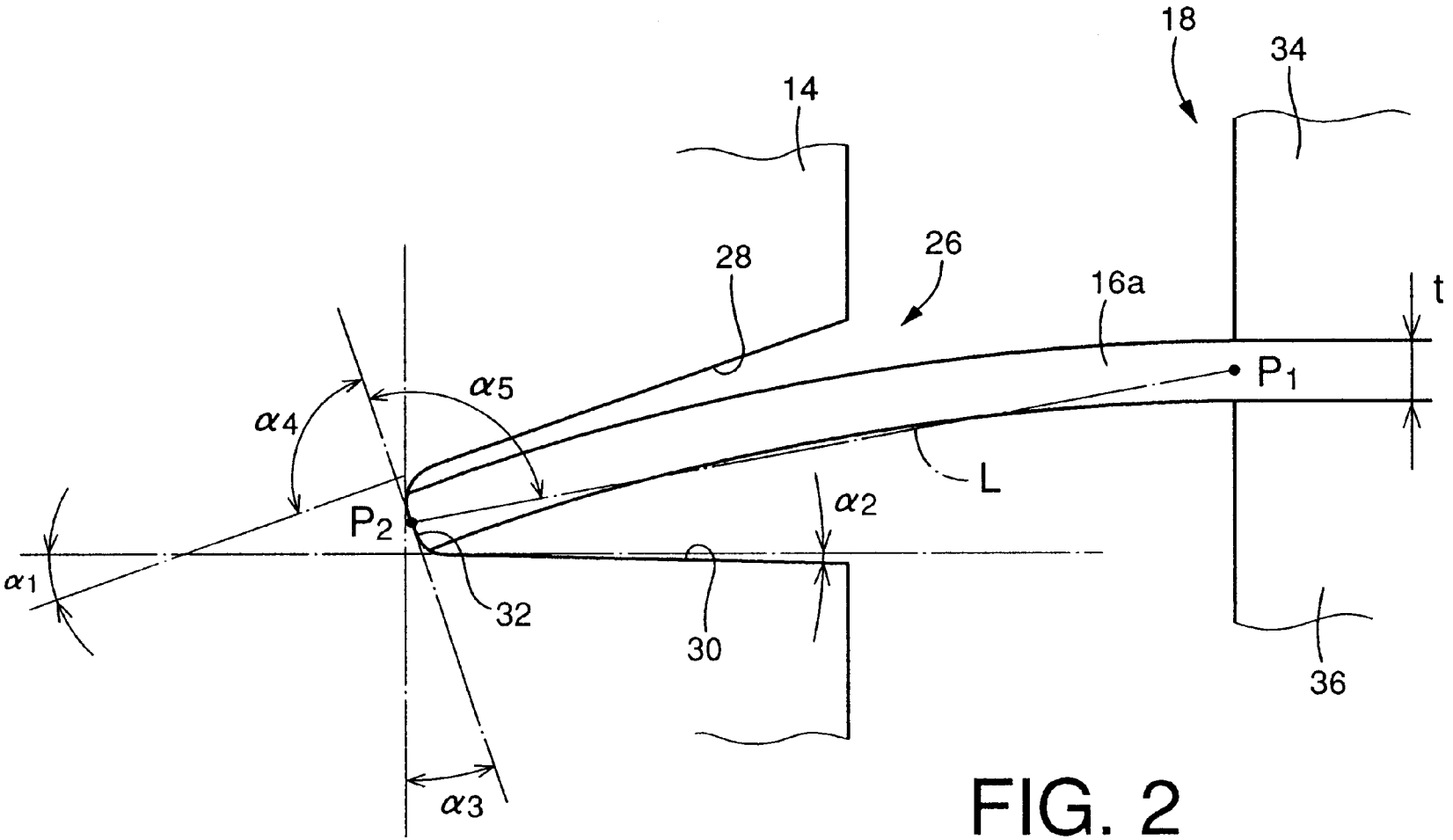
FIG. 2 is a fragmentary view in cross section showing the peripheral portion of the blank when the outer circumferential surface of the peripheral portion is in contact with the bottom surface of a forming groove formed in the outer circumferential surface of a roller die of the swaging apparatus of FIG. 1.
Figure 3A:
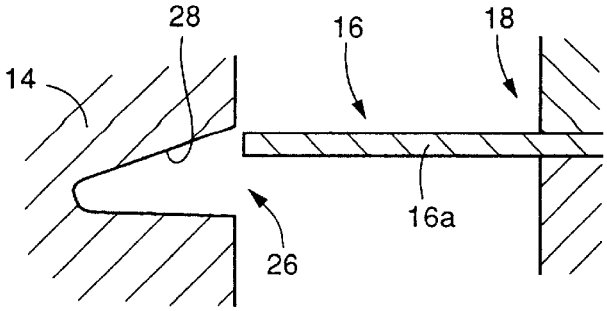
FIGS. 3A–3G are fragmentary cross sectional views illustrating successive steps of swaging performed by the swaging apparatus of FIG. 1 on the peripheral portion of the blank.
Figure 3B:
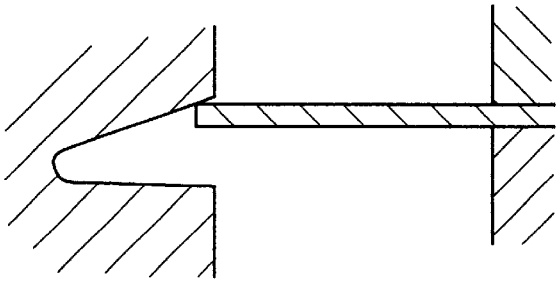
Figure 3C:
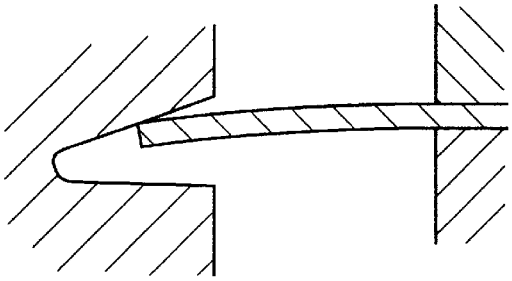
Figure 3D:
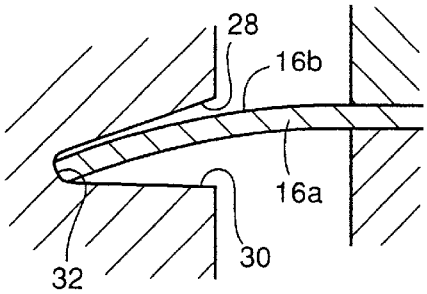

It is noted that FIGS. 3A–3G are cross sectional views taken in a plane which includes the axes S1 and S2 indicated above while FIG. 2 is an enlarged view of FIG. 3D. In FIG. 2, hatching its cross sectional view is dispensed with, for improving the clarity of lead lines of reference signs used therein.

The roller die 14 has an annular forming groove 26 open in its outer circumferential surface 24. The annular forming groove 26 is substantially V-shaped in cross section in a plane including the axis S1 of the roller die 14. As shown in FIG. 2, the axial dimension of the forming groove 26 as measured in the axial direction of the roller die 14 increases in a radially outward direction of the roller die 14. Described more specifically, the forming groove 26 is defined by an annular first or upper side surface 28, an annular second or lower side surface 30 which is generally opposed to the first side surface 28, and a substantially cylindrical bottom surface 32 which is smoothly connected at its axially opposite end portions to the radially inner ends of the first and second side surfaces 28, 30. The end portions of the bottom surface 32 are suitably rounded or curved. The first and second side surfaces 28, 30 have respective angles $\alpha 1$ and $\alpha 2$ of inclination larger than 0° with respect to a straight line which is perpendicular to the axis S1, namely, with respect to a straight line extending in the radial direction of the roller die 14. The first and second side surfaces 28, 30 are inclined with respect to the above-indicated straight line at the respective angles $\alpha 1$ and $\alpha 2$ on the opposite sides of the straight line as viewed in the plane of FIG. 2. The inclinations of the first and second side surfaces 28, 30 are effective to reduce the amount of heat generated due to friction between these surfaces 28, 30 and the blank 16, at a relatively radially outer portion of the roller die 14 at which the peripheral speed is higher than at a relatively radially inner portion of the roller die 14. Accordingly, the inclinations are effective to prevent a change in the properties of the material of the blank due to the generated heat, thereby avoiding an adverse influence of the heat on a swaging or thickening operation to be performed on the blank 16. The bottom surface 32 has an intermediate straight portion whose dimension is substantially equal to a thickness t of the blank 16 and which serves to position the periphery or outer circumferential surface of the blank 16 in the axial direction of the roller die 14, upon abutting contact of the outer circumferential surface of the blank 16 with the bottom surface 32. The straight portion of the bottom surface 32 has an angle $\alpha 3$ of inclination with respect to the axes S1 and S2 such that the radial distance between the straight portion and the axis S1 decreases in the axial direction from the second side surface 30 toward the first side surface 28.

In the present embodiment wherein the axis S1 of rotation of the roller die 14 and the axis S2 of rotation of the blank 16 (blank holder jig 18) are parallel with each other, the above-indicated straight line which is perpendicular to the axis S1 and which is used as a reference line for the angles $\alpha 1$ and $\alpha 2$ is parallel with a straight line perpendicular to the axis S2. Therefore, the above-indicated definitions of the angles $\alpha 1$ and $\alpha 2$ using the axis S1 as a reference may apply to definitions of the angles $\alpha 1$ and $\alpha 2$ using the axis S2 as a reference. However, the definition of the angle $\alpha 3$ using the axis S1 as a reference does not apply to a definition of the angle $\alpha 3$ using the axis S2 as a reference. That is, the straight portion of the bottom surface 32 is inclined at the angle $\alpha 3$ with respect to the axis S2 such that the distance between the axis S2 and the straight portion of the bottom surface 32 at a circumferential position of the bottom surface at which the bottom surface contacts the blank 16 increases in the axial direction of the blank 16 from the second side surface 30 toward the first side surface 28. It will be understood that the circumferential position at which the bottom surface 32 contacts the outer circumferential surface of the blank 16 is on the right side of the axis S1 as seen in FIGS. 1 and 2. The definition of the angle $\alpha 3$ using the axis S2 is applicable to a second embodiment of FIG. 5 wherein the axes S1 and S2 are not parallel, as described below.

The blank holder jig 18 includes a pair of cylindrical pressure members 34, 36 having substantially the same diameter. The upper and lower pressure members 34, 36 are arranged to hold therebetween a radially inner or central portion of the circular plate blank 16 such that a peripheral or radially outer portion **16*a* of the blank 16 extends radially outwardly from the outer circumferential surface of the blank holder jig 18 by a predetermined initial radial overhang distance a, as indicated in FIG. 1. The blank holder jig 18 is positioned relative to the roller die 14 in the axial direction of the jig 18 such that the blank 16 is almost aligned with the radially outer or open end or end portion of the annular first side surface 28 in the axial direction of the jig 18. Namely, the blank 16 is axially positioned by the blank holder jig 18 such that the blank 16 is initially abuttable at its upper surface 16***b* on the radially outer end portion of the first side surface 28, as indicated in FIG. 3B, when the blank 16 is radially moved by the feeding device 22 toward the roller die 14, together with the blank holder jig 18, as indicated in FIGS. 3A–3G. The blank 16 is brought into abutting contact at its outer circumferential surface with the bottom surface 32, as indicated in FIG. 3D, after a further movement of the blank 16 with its upper surface 16*b* (upper peripheral edge) held in sliding contact with the first or upper side surface 28, as indicated in FIG. 3C. As the blank 16 is moved with its upper surface 16*b* in sliding contact with the side surface 28, the periphery of the blank 16 is downwardly displaced toward the bottom surface 32, and the outer peripheral portion 16*a* of the blank 16 which extends radially outwardly from the jig 18 is flexed in an upwardly convex shape.

The angle $\alpha 3$ of inclination of the straight portion of the bottom surface 32 is determined such that an angle $\alpha 5$ which is formed, on the side of the first side surface 28, between the straight portion and a line L connecting points P1 and P2 indicated in FIG. 2 upon abutting contact of the outer circumferential surface of the blank 16 with the bottom surface 32 is 90° or larger. The point P1 is a center point of the thickness t of the blank 16 which lies on the outer circumferential surface of the blank holder jig 18, while the point P2 is a center point a the straight portion of the bottom surface 32 as seen in the direction of thickness of the blank 16. In this arrangement the thickness centerline of the blank 16 in its radial outermost part or extreme end part of the outer peripheral portion 16*a* is almost perpendicular to the straight portion of the bottom surface 32 when the radially outermost part of the blank is flexed in an upwardly convex shape following the first side surface 28. Further, the angle $\alpha 3$ is determined such that an angle $\alpha 4$ formed between the straight portion of the bottom surface 32 and the first side surface 28 is about 90°.

In the present embodiment, the feeding device 22 includes an electric motor, a feedscrew in the form of a ballscrew connected to the electric motor, and a ball nut which is fixed to the blank rotating device 20 and which engages the ballscrew. An operation of the electric motor will cause the blank rotating device 20 to be linearly moved together with the blank holder jig 18 and the blank 16, relative to the roller die 14 in the radial direction of the roller die 14, when a swaging operation on the outer peripheral portion 16*a* of the blank 16 is performed with the roller die 14, so as to increase the thickness at its radially outermost part, with the blank 16 being forced at its outer circumferential surface against the bottom surface 32 of the forming groove 26 formed in the roller die 14. The torque of the electric motor of the feeding device 22, which determines a force F acting between the bottom surface 32 and the blank 16, is controlled by a control device not shown, according to a predetermined pattern determined by experimentation, for instance, so that the radially outermost part of the blank 16 can be efficiently thickened in the opposite directions toward the first and second side surfaces 28, 30 while the outer peripheral portion 16*a* is kept spaced apart from the first and second side surfaces 28, 30, and is prevented from buckling or bending toward the second side surface 30. The electric motor of the feeding device 22 may be controlled such that the feeding velocity of the blank 16, rather than the above-indicated force F (torque of the motor), is controlled according to a predetermined pattern. The torque of the electric motor or the feeding velocity of the blank 16 may be controlled in a feedback fashion, so that the operation to thicken the radially outermost or extremely peripheral part of the outer peripheral portion 16*a* is performed while the state of flexural or bending deformation of the outer peripheral portion 16*a* is suitably controlled on the basis of an output of a suitable displacement sensor adapted to detect the deformation of the outer peripheral portion 16*a*. The displacement sensor may be of a non-contact type.

The blank rotating device 20 may be arranged and controlled to rotate the blank holder jig 18 and the blank 16 at a predetermined speed during all steps of the swaging or thickening operation shown in FIGS. 3A–3G. However, the rotating speed of the blank 16 may be suitably controlled, according to a predetermined pattern. The roller die 14 is rotated about its axis S1 in frictional rolling contact with the blank 16 rotated by the blank rotating device 20.

In the step shown in FIG. 3D in which the outer circumferential surface of the blank 16 is brought into abutting contact with the bottom surface 32, the force acts on the bottom surface 32 in the direction perpendicular to the bottom surface 32. If the upper surface 16*b* contacts the first side surface 28, a force acts on the first side surface 28 in the direction perpendicular to the surface 28, whereby a reaction force acts on the outer peripheral portion 16*a* in the direction toward the second side surface 30, tending to cause buckling of the outer peripheral portion 16*a* toward the second side surface 30. In this sense, it is required to control the force F between the bottom surface 32 and the outer circumferential surface of the blank 16, so as to prevent a contact of the outer peripheral portion 16*a* with the first side surface 28. The outer circumferential surface of the blank 16 which receives the reaction force from the bottom surface 32 is subjected to a dynamic friction due to a movement of the outer circumferential surface relative to the bottom surface 32, so that there arises material flows between the outer circumferential surface of the blank 16 and the bottom surface 32. As a result, the radially outermost part of the outer peripheral portion 16*a* of the blank 16 is thickened in the opposite directions from the upper and lower surfaces 16*b*, 16*c* toward the first and second side surfaces 28, 30, respectively, as indicated in FIG. 3E.

Figure 3F:
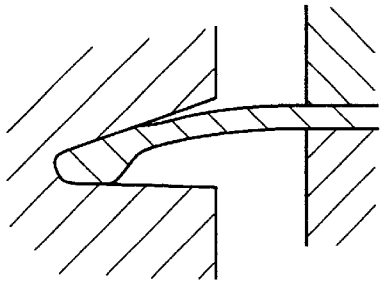
Figure 3E:
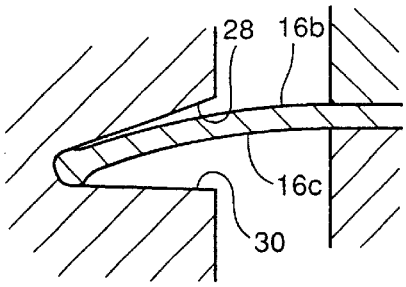
Figure 3G:
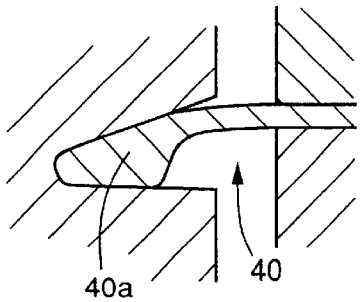

In the subsequent steps shown in FIGS. 3F and 3G, the initially thickened radially outermost part of the peripheral portion 16*a* is further thickened gradually as the peripheral portion 16 is further moved into the forming groove 26, so that there is obtained an intermediate product 40 whose outer peripheral portion is thickened following the cross sectional configuration of the forming groove 26. The thickening of the outer peripheral portion 16*a* of the blank 16 by the roller die 14 is controlled and influenced by various factors including: the force F acting between the outer circumferential surface of the blank 16 and the bottom surface 32 of the forming groove 32; the rotating speed of the roller die 14; friction coefficients of the surfaces 28, 30, 32 of the forming groove 26; a modulus of elasticity of the blank 16; the absence or presence of a lubricant between the contacting surfaces of the blank 16 and the forming groove 26; and the ambient temperature and humidity. After the thickening of the blank 16 is initiated, the thickness t of the blank 16 is gradually reduced, and the outer peripheral portion 16*a* becomes relatively unlikely to buckle, so that the force F or the speed of movement of the blank 16 into the forming groove 26 can be increased to promote the subsequent thickening of the blank 16. Namely, if the buckling of the outer peripheral portion 16*a* toward the second side surface 30 can be prevented in the step of FIG. 3D, a possibility of the buckling of the peripheral portion 16*a* decreases as the thickening at its radially outermost or extremely peripheral part progresses.

In steps of FIGS. 3B and 3C, the outer peripheral portion 16*a* of the blank 16 is moved into the forming groove 26, with the upper surface 16*b* (upper peripheral edge) of the blank 16 being held in sliding contact with the first side surface 28, so that the portion 16*a* is slightly downwardly displaced and is flexed in an upwardly convex shape following the first side surface 28, upon abutting contact of the outer circumferential surface of the blank 16 with the bottom surface 32 of the forming groove 26. Accordingly, the downward buckling of the outer peripheral portion 16*a* toward the second side surface 30 can be prevented. The amount of upward flexure of the outer peripheral portion 16*a* is determined by the material of the blank 16 and other factors. Although the present embodiment is adapted such that the outer peripheral portion 16*a* is inserted into the forming groove 26 in sliding contact with the first side surface 28, so that the portion 16*a* is upwardly convex toward the first side surface 28 in the step of FIG. 3D, the outer circumferential surface of the blank 16 may be directly brought into abutting contact with the bottom surface 32, without a contact of the upper surface 16*b* with the first side surface 28. In this case, either the roller die 14 or the blank holder jig 18 (blank 16) is vertically moved in its axial direction (along the axis S1 or S2) while the outer circumferential surface of the blank 16 is kept in rolling contact with the bottom surface 32, so that the outer peripheral portion 16*a* is convex either upwardly toward the first side surface 28 or downwardly toward the second side surface 30.

Figure 4A:
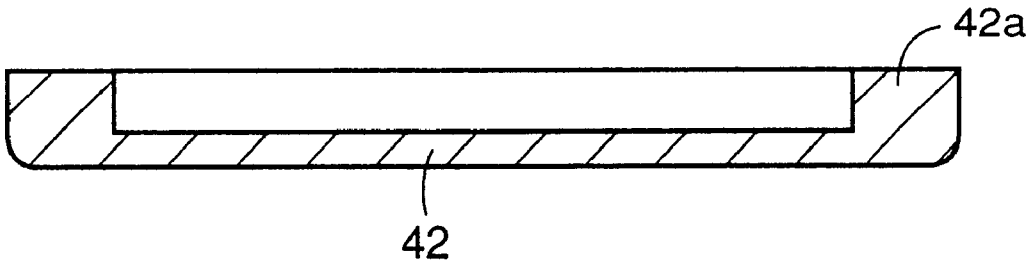
FIG. 4A is a view showing a plate obtained by swaging of the blank by the apparatus of FIG. 3.
Figure 4B:
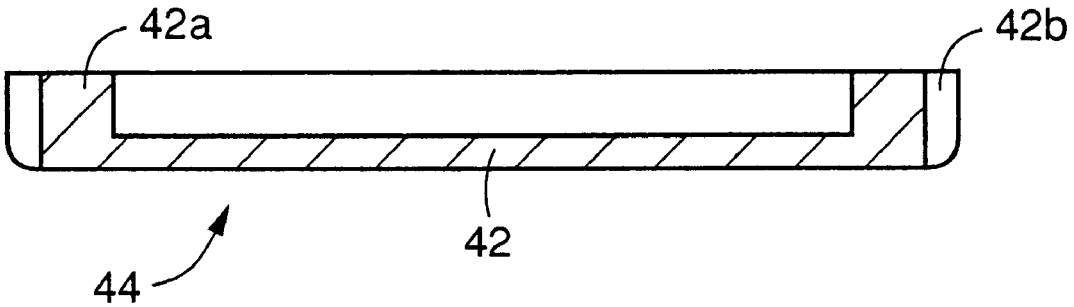
FIG. 4B is a view showing a drive plate formed by forming an outer toothed portion on the peripheral portion of the plate of FIG. 4A.

The intermediate product 40 shown in FIG. 3G, which has a thickened peripheral portion 40*a*, is moved away from the roller die 14. At this time, the thickened peripheral portion 40*a* is more or less displaced upwardly due to a spring-back effect. However, the thickened peripheral portion 40*a* remains downwardly offset from the radially inner portion of the intermediate product 40. This intermediate product 40 is used for producing a final or end product in the form of a drive plate 44 shown in FIG. 4B, which is used in an automotive vehicle. That is, the intermediate product 40 is shaped into a plate 42 shown in FIG. 4A, by using a roller die which has an annular forming groove having a rectangular cross sectional shape. The plate 42 has a thick-walled cylindrical peripheral portion 42*a*, which is subjected to a rolling or machining operation to form a toothed portion 42*b* on the drive plate 44, as shown in FIG. 4B. Thus, the desired drive plate 44 having the toothed portion or ring gear 42*b* is eventually produced.

For instance, the above-indicated shaping roller die for shaping the intermediate product 40 may be rotatably disposed such that the present shaping roller die and the thickening roller die 14 are positioned at respective two positions which are opposed to each other diametrically of the blank holder jig 18, so that the intermediate product 40 held by the blank holder jig 18 is moved by the feeding device 22 in the right direction as seen in FIG. 1, for inserting the thickened peripheral portion 40*a* of the intermediate product 40 into the rectangular forming groove in the shaping roller die.

The drive plate 44 is installed in an automotive vehicle such that the toothed portion 42*b* meshes with a pinion gear rotated by an engine starter motor, and such that the drive plate 44 is bolted at its inner or central flat portion to a crankshaft of the engine, so that the engine can be started by the engine starter motor through the drive plate 44. Alternatively, the drive plate 44 is disposed between the crankshaft and a torque converter of an automatic transmission, so as to absorb a slight axial movement or vibration of the crankshaft due to vibration of the engine, or an error in the axial position of the torque converter relative to the crankshaft. It is noted that the plate 42 as shown in FIGS. 4A and 4B is inverted upside down with respect to the orientation of the intermediate product 40 as shown in FIG. 3G.

In the rotary swaging apparatus 10 used according to the present embodiment, the force F acting between the roller die 14 and the blank 16 is adjusted so that the outer peripheral portion 16*a* of the blank 16 which extends radially outwardly from the blank holder jig 18 is flexed in an upwardly convex shape following the first side surface 28, while the outer peripheral portion 16*a* is kept spaced apart from the first and second side surfaces 28, 30, and is prevented from buckling or bending in the forming groove 26, whereby that the radially outermost part of the portion 16*a* can be efficiently thickened in the opposite directions toward the first and second side surfaces 28, 30, without buckling of the outer peripheral portion 16*a*.

Since the thickening is effected so as to prevent the outer peripheral portion 16*a* from contacting the first and second side surfaces 28, 30, the cross sectional shapes or configurations of these surfaces 28, 30 which determine the cross sectional shape of the thickened peripheral portion 40*a* of the intermediate product 40 can be designed with a high degree of freedom, unless the surfaces 28, 30 adversely influence the flexure of the outer peripheral portion 16*a* during the swaging or thickening operation.

Further, the outer peripheral portion 16*a* of the blank 16 can be flexed, with high stability, in a convex shape following the first side surface 28, since the straight portion of the bottom surface 32 of the forming groove 26 is inclined at the predetermined suitable angle $\alpha 3$ with respect to the axis S1 such that the radial distance between the bottom surface 32 and the axis S1 decreases in the axial direction from the second side surface 30 toward the first side surface 28.

Figure 6A:
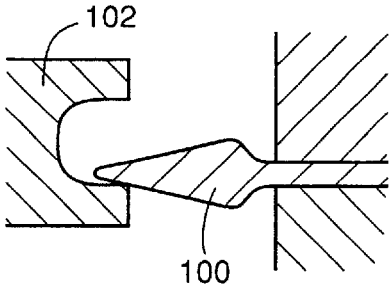
FIG. 6A PRIOR ART
FIGS. 6A, 6B and 6C are fragmentary cross sectional views illustrating successive steps performed in a conventional swaging method wherein the peripheral portion of the blank which has been thickened with symmetrical flows of the material on both of its upper and lower sides is folded so that the peripheral portion is formed to have a cylindrical shape.
Figure 6B:
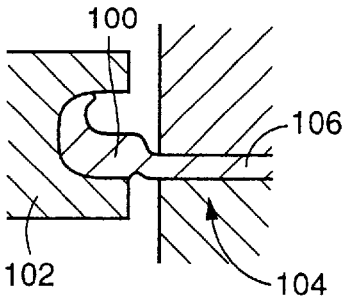
FIG. 6B PRIOR ART
Figure 6C:
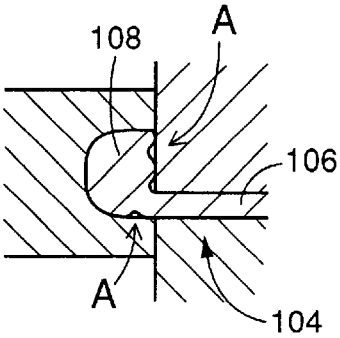
FIG. 6C PRIOR ART
Figure 7:
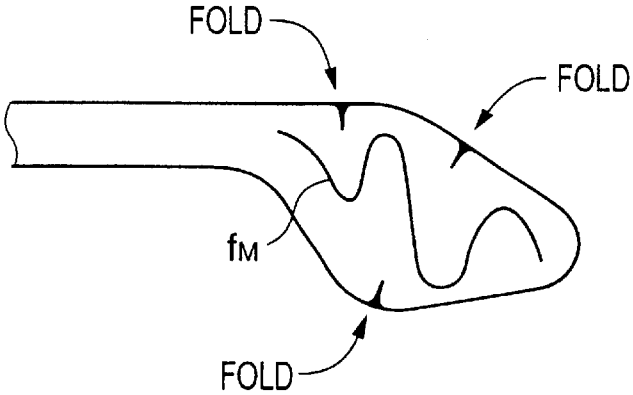
FIG. 7 PRIOR ART
FIG. 7 is a view indicating a meandering flow,of the material at the peripheral portion of the blank during conventional swaging of the blank which involves buckling and folding of the peripheral portion.
Figure 8:
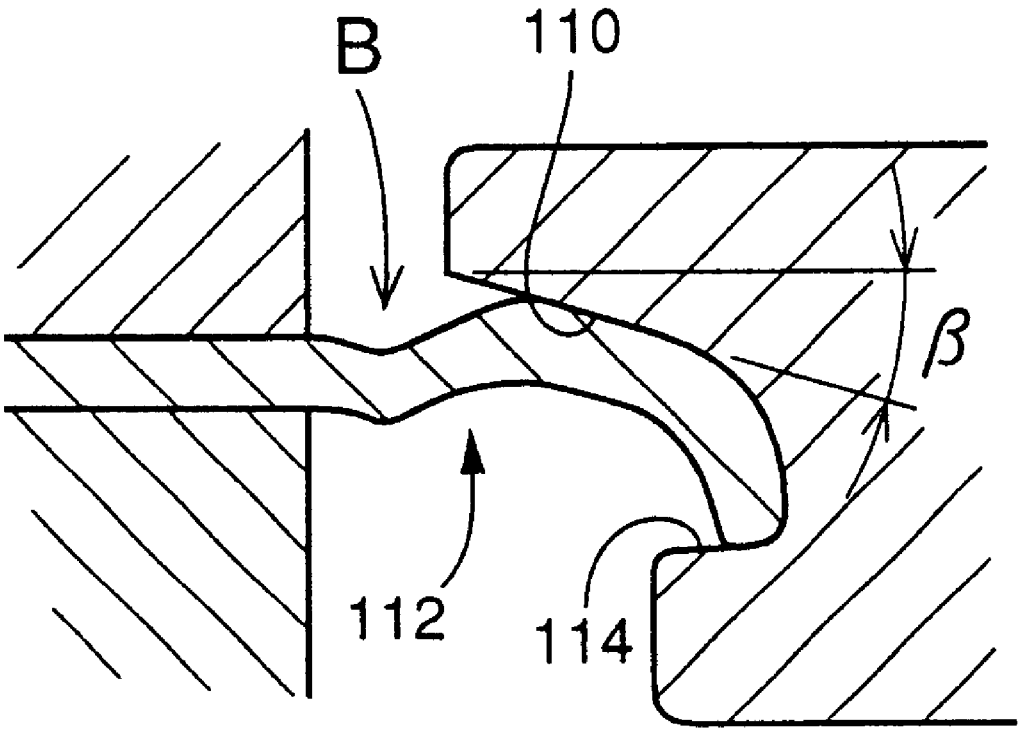
FIG. 8 PRIOR ART
FIG. 8 is a view showing a further conventional swaging method.

The present method of forming the blank 16 has a further advantage owing to the initial alignment of the blank 16 with the radially outer end of the first side surface 28 in the axial direction of the blank holder jig 18, and owing to the subsequent movement of the blank 16 (blank holder jig 18) toward the roller die 14 in the radial direction of the blank 16 (roller die 14). According to this arrangement, the initial thickening of the radially outermost part of the portion 16a, which takes place in the opposite directions toward the first and second side surfaces 28, 30, as indicated in FIGS. 3E and 3F, is followed by the subsequent thickening which takes place asymmetrically on the first and second side surfaces 28, 30. That is, after the radially outermost part of the outer peripheral portion 16*a* is thickened up to the initial axial position of the blank 16 held by the blank holder jig 18, the thickening takes place primarily on the side of the second side surface 30, so that the thickened peripheral portion 40*a* of the intermediate product 40 can be suitably offset on the side of the lower surface 16*c* of the outer peripheral portion 16*a* of the blank 16, without folding of the portion 16a, as indicated in FIG. 3G. As a result, the plate 42 having the cylindrical thickened peripheral portion 42*a* which extends from one surface of the inner flat portion as shown in FIG. 4A can be obtained from the intermediate product 40 having the offset thickened peripheral portion 40*a*. Since the thickened peripheral portion 40 of the intermediate product 40 does not have undesirable hairpin folds or bends as indicated at A in FIG. 6C, the toothed portion 42*b* formed by rolling or machining the peripheral portion 42*a* of the plate 42 has increased mechanical strength and durability.

Figure 5:
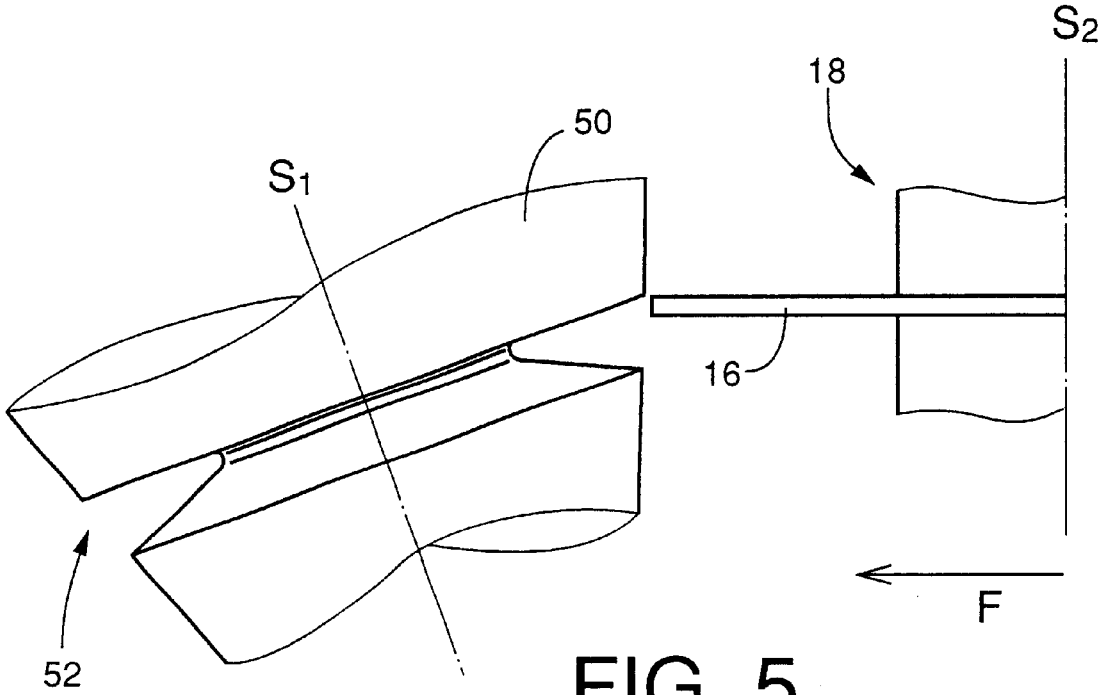
FIG. 5 is a view illustrating a rotary swaging apparatus used in a second embodiment of this invention.

The present rotary swaging apparatus 10 wherein the rotation axes S1, S2 of the roller die 14 and the blank holder jig 18 are parallel with each other can be made smaller in size with a relatively smaller distance between the rotary tool holding device 12 and the blank rotating device 20, than a rotary swaging apparatus shown in FIG. 5 according to a second embodiment of this invention wherein an axis S1 of rotation of a roller die 50 is inclined with respect to the axis S2 of rotation of the blank holder jig 18. The swaging apparatus of FIG. 5 is also adapted to increase the thickness of the outer peripheral portion 16*a* of the blank 16 while the portion 16*a* is flexed in an upwardly convex shape, and therefore has substantially the same advantages as the apparatus according to the first embodiment. The roller die 50 has an annular forming groove 52 which is shaped such that its cross sectional shape on the right side of the axis S1 as seen in FIG. 5 (on the side which engages the blank 16) is the same as that of the forming groove 26, as seen when the roller die 50 is installed with its axis S1 being inclined at a predetermined angle with respect to the axis S2.

It is also noted that the illustrated embodiments permit stable thickening of the radially outermost part of the outer peripheral portion 16*a* of the blank 16 in the opposite directions toward the first and second side surfaces 28, 30, owing to the inclination angle $\alpha 3$ of the straight portion of the bottom surface 32 of the forming groove 26, 52 with respect to the axis S1, which angle $\alpha 3$ is determined such that the straight portion is substantially perpendicular to the peripheral part of the outer peripheral portion 16*a* of the blank 16 which is near the outer circumferential surface, while the outer peripheral portion 16*a* is flexed following the first side surface 28, with the outer circumferential surface of the blank 16 being held in rolling contact with the bottom surface 32, so that the reaction force received by the outer circumferential surface of the blank 16 from the straight portion of the bottom surface is almost evenly distributed on the opposite sides of the blank 16.

While the presently preferred embodiments of this invention have been described in detail by reference to the accompanying drawings, for illustrative purpose only, it is to be understood that the invention may be embodied with various changes, modifications and improvements, which may occur to those skilled in the art, without departing from the spirit and scope of the present invention defined in the following claims.

What is claimed is:

1. A method of forming a peripheral portion of a blank in the form of a circular plate, so as to thicken said peripheral portion, comprising the steps of:

providing a roller die supported rotatably about an axis thereof and having an outer circumferential surface and an annular forming groove which is open in said outer circumferential surface, said forming groove having a first side surface, a second side surface spaced from said first side surface in an axial direction of said roller die, and a bottom surface which has rounded end portions smoothly connecting said first and second side surfaces;

providing a blank holder jig which has an axis of rotation and an outer circumferential surface and which holds said blank;

holding said blank on said blank holder jig such that said blank is coaxial with said blank holder jig and said peripheral portion extends radially outwardly from said outer circumferential surface over a predetermined radial distance;

rotating said blank about said axis of said blank holder jig such that said blank is held in pressing contact at an outer circumferential surface thereof with said bottom surface of said annular forming groove of said roller die, so that said outer peripheral portion of said blank is thickened following a shape of said forming groove in cross section taken in a plane including said axis of said roller die;

forming said first side surface and positioning said roller die relative to said blank holder jig such that said first side surface is inclined at an angle $\alpha 1$ larger than 0° with respect to a radial direction of said blank holder jig such that an axial distance between said first and second side surfaces in an axial direction of said blank holder jig increases in a radially outward direction of said roller die; and controlling a force acting between said outer circumferential surface of said blank and said bottom surface of said forming groove, during rotation of said blank in pressing contact with said bottom surface, so that said outer peripheral portion of said blank is held flexed in a convex shape following said first side surface and so that a radially outermost part of said outer peripheral portion is thickened in opposite directions toward said first and second side surfaces while said outer peripheral portion is spaced apart from said first and second side surfaces, and is prevented from buckling within said forming groove.

2. A method according to claim 1, wherein said bottom surface of said annular forming groove is formed such that said bottom surface has an intermediate straight portion which is located between said rounded end portions and which has a dimension substantially equal to a thickness "t" of said blank, so that said intermediate straight portion serves to position said outer circumferential surface of said blank in an axial direction of said roller die, upon abutting contact of said outer circumferential surface with said intermediate straight portion.

3. A method according to claim 1, wherein said bottom surface of said annular forming groove has an angle $\alpha 3$ of inclination with respect to said axis of rotation of said blank holder jig such that a distance between said axis of rotation of said blank holder jig and said bottom surface at a circumferential position of said bottom surface at which said bottom surface contacts said outer circumferential surface of said blank increases in an axial direction of said blank holder jig from said second side surface toward said first side surface.

4. A method according to claim 3, wherein said angle $\alpha 3$ of inclination of said bottom surface is determined such that a thickness centerline of said blank at a radially outermost part of said outer peripheral portion of said blank is almost perpendicular to said bottom surface when said radially outermost part is flexed in said convex shape following said first side surface, so that a reaction force received by said outer circumferential surface of said blank from said bottom surface of said forming groove is almost evenly distributed on the opposite sides of said blank toward said first and second side surfaces of said forming groove, for permitting efficient and stable thickening of said radially outermost part of said blank in the opposite directions toward said first and second side surfaces.

5. A method according to claim 1, wherein said blank is held by said blank holder jig such that said blank is substantially aligned with said first side surface of said annular forming groove in said axial direction of said blank holder jig, before said blank is brought into pressing contact with said roller die, said method further comprising a step of moving said blank holder jig and said roller die relative to each other in said radial direction of said blank holder jig, while said blank is rotated about said axis thereof, so that said outer peripheral portion of said blank is thickened.

6. A method according to claim 5, wherein said bottom surface of said annular forming groove has an angle $\alpha 3$ of inclination with respect to said axis of rotation of said blank holder jig such that a distance between said axis of rotation of said blank holder jig and said bottom surface at a circumferential position of said bottom surface at which said bottom surface contacts said outer circumferential surface of said blank increases in an axial direction of said blank holder jig from said second side surface toward said first side surface, said angle $\alpha 3$ of inclination of said bottom surface being determined such that an angle $\alpha 5$ which is formed, on the side of said first side surface, between said bottom surface and a line L connecting points P1 and P2 upon abutting contact of said outer circumferential surface of said blank with said bottom surface is not smaller than 90°, wherein said point P1 is a center point of a thickness of said blank which lies on said outer circumferential surface of said blank holder jig, while said point P2 is a center point of said bottom surface as measured in the direction of thickness of said blank.

7. A method according to claim 5, wherein said blank is held by said blank holder jig such that said blank is substantially aligned with a position of a radially outer end of said first side surface of said annular forming groove in said axial direction of said blank holder jig, before said outer peripheral portion of said blank is brought into abutting contact with said first side surface, so that said outer peripheral portion is flexed by sliding pressing contact at a peripheral edge thereof with said first side surface as said blank holder jig and said roller die are moved toward each other.

8. A method according to claim 5, wherein said blank is held by said blank holder jig such that said blank is substantially aligned with a position of said bottom surface of said annular forming groove in said axial direction of said blank holder jig, before said outer circumferential surface of said blank is brought into abutting contact with said bottom surface, said method further comprising a step of moving one of said blank and said roller die in the axial direction of said blank, with said outer circumferential surface being held in pressing contact with said bottom surface, for flexing said outer peripheral portion of said blank in said convex shape following said first side surface.

9. A method according to claim 1, wherein said roller die and said work holder jig are positioned relative to each other such that said axes of rotation of said roller die are parallel with each other, and said roller die and said blank holder jig are moved relative to each other in said radial direction of said blank holder jig along a straight line connecting said axes.

10. A method according to claim 1, wherein said roller die and said work holder jig are positioned relative to each other such that said axes are inclined relative to each other in a plane including said axes, and said roller die and said work holder jig are moved relative to each other along one of a straight line connecting said axes in said plane and a circular arc which passes an outer periphery of said blank and an outer periphery of said annular forming groove in said plane.

11. A method according to claim 1, wherein said blank holder jig and said roller die are moved toward each other by a drive device including an electric motor, so as to force said outer peripheral portion of said blank against said first and second side surfaces and said bottom surfaces of said annular forming blank, said method further comprising a step of controlling a torque of said electric motor for controlling a force which acts between said outer peripheral portion and said annular forming groove.

12. A method according to claim 1, further comprising a step of controlling a speed of a movement of said blank holder jig and said roller die toward each other, so as to control a force acting between said outer peripheral portion of said blank and said roller die.

13. A method according to claim 1, wherein only one of said roller die and said blank holder jig is rotated by a rotating device relative to the other of said roller die and said blank holder jig, while said other of said roller die and said blank holder jig is rotatably supported by a rotary holding device, so that said other of said roller die and said blank holder jig is rotated in rolling contact with said blank.

14. A method according to claim 1, wherein only one of said roller die and said blank holder jig is moved by a feeding device relative to the other of said roller die and said blank holder jig.

* * * * *